United States Patent [19]

Oppenländer et al.

[11] 4,231,684

[45] Nov. 4, 1980

[54] SHIELD TYPE SUPPORT FOR USE IN UNDERGROUND MINING WITH LEMNISCATE GUIDE RODS

[75] Inventors: Harry Oppenländer, Wetter; Ulrich Wilde, Essen, both of Fed. Rep. of Germany

[73] Assignee: Thyssen Industrie AG, Fed. Rep. of Germany

[21] Appl. No.: 68,559

[22] Filed: Aug. 22, 1979

[30] Foreign Application Priority Data

Sep. 22, 1978 [DE] Fed. Rep. of Germany ..... 2841190

[51] Int. Cl.[3] ..... E21D 15/44

[52] U.S. Cl. ..... 405/291; 405/295

[58] Field of Search ..... 405/291–302; 299/31; 91/170 MP; 248/357

[56] References Cited

U.S. PATENT DOCUMENTS

| | | | |
|---|---|---|---|
| 3,959,976 | 6/1976 | Blumenthal | 405/290 |
| 4,027,489 | 6/1977 | Walker et al. | 405/296 |
| 4,102,140 | 7/1978 | Allen | 405/293 |

FOREIGN PATENT DOCUMENTS

| | | | |
|---|---|---|---|
| 1521970 | 8/1978 | United Kingdom | 405/291 |
| 221631 | 3/1968 | U.S.S.R. | 405/296 |

*Primary Examiner*—Dennis L. Taylor

*Attorney, Agent, or Firm*—McGlew and Tuttle

[57] ABSTRACT

A shield type support for use in underground mining comprises a floor construction with one or more pressure operated extensible and retractable rams mounted on the floor and connected at their upper end to a roof-member. The roof-member is articulated at one end to a breaking shield which has an opposite end which is supported by lemniscate guide rods. The lemniscate guide rods are carried on a support which is mounted for adjustable movement on a column supported on the floor. In addition, this support also advantageously carries an additional adjusting element in the form of a telescopically retractable and extensible ram connected between the support and the roof structure at a spaced location from the other rams.

12 Claims, 7 Drawing Figures

SHIELD TYPE SUPPORT FOR USE IN UNDERGROUND MINING WITH LEMNISCATE GUIDE RODS

BACKGROUND OF THE INVENTION

Field of the Invention

This invention relates in general to underground mining devices and, in particular, to a new and useful shield-type stope support for use in underground mining.

Shield-type stope supports with lemniscate guide rods for use in underground mining, particularly in hard coal mining, are known in great numbers. In these shield-type stope supports, a breaking shield is articulated to the rest of the support over lemniscate guide rods. The lemniscate guide rods serve both to stabilize and guide the roof construction, and to ensure a possibly vertical adjustability of the roof construction in the range of the working face.

In the known shield-type stope supports with lemniscate guide rods, these are arranged stationary but pivotably in the range of the floor construction. For this reason, the adjustability of such a support is limited by the length of the lemniscate guide rods. In order to be able to use such stope supports for greater seam thicknesses too, lemniscate guide rods of two meter lengths and more have already been used. This results in a wider adjustment range of the respective support, but on the other hand, the breaking shield swings out by a considerable amount at the mine filling and during the adjustment, so that the respective support is blocked in its vertical adjustability by the mine filling at the working face.

But since one cannot always build new stope supports for varying seam thickensses, it has already been suggested, at least on paper, to change the stope supports to different thicknesses in reconstructions, that is, after the timbers and the stope supports have been removed. For example, it has already been suggested, the applicant is not absolutely sure whether this is the actually practiced state of the art, to secure in the floor construction boxes with which the lemniscate guide rods facing the floor construction can be coupled. Such reconstructions however, are not possible during normal operation since it causes stoppages and requires an extremely long time with the corresponding costs.

SUMMARY OF THE INVENTION

The invention is based on the problem of providing a relatively compact shield-type stope support which has a great vertical adjustability with short lengths of the lemniscate guide rods, and can thus be used for varying seam thickensses. The angle under which the breaking shield drops to the mine filling should be flat.

In accordance with the invention, there is provided a shield-type stope support for use in underground mining which comprises a floor construction having at least one fluid pressure operated extensible and retractable ram thereon, which is connected at its upper end to a roof member and which also includes at least one column on the floor support structure which extends upwardly toward the roof structure with a breaking shield articulated at its one end to the roof structure connected at its opposite end to a lemniscate guide rod mechanism which are supported at their opposite ends on a support structure mounted on a column for upward and downward movement.

The fact that the articulation of the lemniscate guide rod is also vertically adjustable in normal operation, has the advantage that a great vertical adjustability of the stope support is achieved with very short lemniscate guide rods, so that the same stope support can be used for greatly varying thicknesses. The stope supports need no longer be changed, as heretofore. Rather the articulations of the lemniscate guide rods can be adjusted during normal operation, e.g. during the mining, and also be locked at the desired level between roof and floor construction. The result is that no stoppages are required with the use of the stope supports according to the invention. Rather the operation in the longwall can continue without interruption as heretofore. The adjustability of the articulations of the lemniscate guide rods can be effected within a short time with only a few manipulations, and it is not necessary in the embodiments according to the invention to add this time to the time that elapses anyway during the progress of the support.

Another advantage is that, because of the relatively short lemniscate guide rods, the breaking shield projects only by a small amount on the mine filling side, and there is no risk during the vertical adjustment of the stope support that the breaking shield will be jammed by filling material.

In the preferred form of the invention, the column forms a guide which extends between the roof structure and the floor structure and the support for the lemniscate guide rods comprises a member which engages around the column and moves upwardly and downwardly in respect thereto. Advantageously, two columns are employed in spaced parallel relationship and the support structure includes tubular members which embrace each column and have a connecting piece therebetween.

The additional column suggested in this embodiment contributes to the greater stability of the stope support and can be designed, if necessary, like the rest of the rams or the other rams, which are arranged between the floor and roof constructions. These rams arranged between the floor and roof construction are as a rule hydraulic rams, which can be selectively pressurized on either side of an extensible part with hydraulic pressure to extend or retract the ram.

The construction according to claim 3 yields a particularly stable structure which can be used with great advantage, for example, in underground hard coal mining. Since the bearing pieces are integrally joined with each other, these bearing pieces move synchronously in the adjustment, so that no alignment operations are necessary. A particular advantage is that this vertical adjustment can be effected by a vertical adjusting element.

In the embodiment according to claim 4, the bearing pieces are integrally joined with each other by a traverse. This traverse can also serve, if necessary, as a fastening abutment for the vertical adjusting element, while it is articulated at the other end on the roof construction.

Of particular advantage is an embodiment according to claim 5, where the vertical adjusting element is designed as a ram that can be admitted alternately on both sides with pressure medium pressure, e.g. a hydraulic ram; it can thus be designed in the same manner as the other rams arranged between floor and roof construction. These rams are also called thrust piston gears.

Naturally embodiments are also within the framework of the invention where the vertical adjusting element passes through the space between the bearing pieces. For example, it is conceivable to articulate the vertical adjusting element at one end of the roof and at the other end on the floor construction, so that is passes through the traverse. This traverse can be provided with a suitable screw thread, e.g. a trapezoidal or saw-tooth thread, which is engaged by a nut actuated by the vertical adjusting element. By extending and retracting the vertical adjusting element, the bearing pieces can be adjusted in height over the traverse and locked at the desired level.

In the embodiment according to claim 9, the columns have several apertures, openings, for example, bores, which can be assigned with one or several other apertures, openings or bores. This way, locking means, like bolts etc, can be put through these openings so that the bearing pieces can be locked at the desired level. Another embodiment can have, for example, double the adjustment range regarding the seam thickness that would otherwise be used for an assumed length of the lemniscate guide rods. If the respective stope support could be adjusted in height only by a maximum amount X with an assumed very short lemniscate guide rod length, this stope support can be adjusted in height by 2X or more by adjusting and locking the fulcrums of the lemniscate guide rods with constant short lemniscate guide rods.

In another particularly advantageous embodiment a ram can be used at the same time as a vertical adjusting element. The adjustment of the bearing pieces, hence of the fulcrums of the lemniscate guide rods, can be effected in this embodiment, e.g. in a simple manner by clearing the hydraulic ram forming the vertical adjusting element, after at least one, but preferably several rams have been set between the roof and floor constructions. This is done naturally after loosening first other fastening parts of the bearing pieces, so that vertical adjusting element (ram) adjusts the bearing pieces in the direction of the roof over the traverse, etc. until either the stroke is exhausted or the admission of the vertical adjusting element with pressure medium is interrupted. This is not always necessary or only in exceptional cases, e.g. the respective stope support may be advanced in the direction of the working progress by a sort of positive control during the vertical adjustment of the fulcrums of the lemniscate guide rods. This tends to prevent any deflections of the breaking shield.

Accordingly, it is an object of the invention to provide a shield-type stope support for use in underground mining which comprises a floor construction with at least one fluid pressure operated extensible and retractable ram mounted on the floor construction and having a top end and a bottom end and including a roof member connected to the top end of the ram and at least one column mounted on said floor structure extending upwardly therefrom toward said roof member, with a breaking shield having one shield end pivotally connected to the roof structure at a spaced location from the connection of ram to the roof structure and an opposite shield second end and with a lemniscate support mounted on said column for upward and downward movement thereon, and a pair of lemniscate guide rods having front ends pivotally connected to said support and opposite second ends pivotally connected to said shield second end.

A further object of the invention is to provide a shield type stope support which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
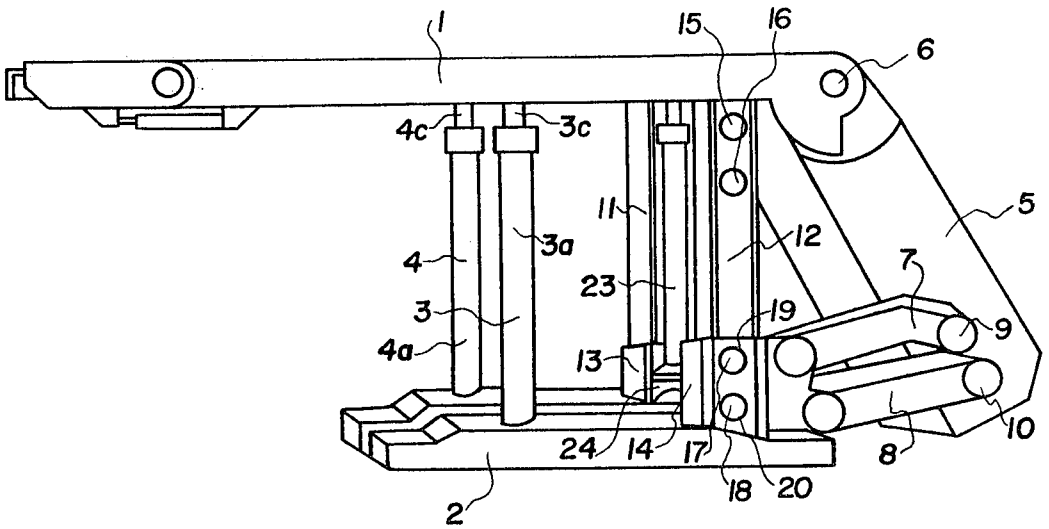
FIG. 1 is a front-side perspective view of a shield-type stope support constructed in accordance with the invention.

Referring to the drawings in particular, the invention embodied therein comprises a shield-type stope support for use in underground mining which comprises a roof member or roof construction 1 disposed above a floor or floor construction 2. Between the roof construction 1 and the floor construction 2 are arranged one or more fluid pressure operated telescopic rams which in this embodiment comprises two rams, 3 and 4, each including a bottom portion 3*a* (4*a*) and one or more telescopic upper portions 3*b*, 3*c* and 4*b* and 4*c*. The telescopic portions The telescopic portions are extended from the base portion 3*a* and 4*a* by admitting fluid pressure in a direction across such extension and this pressure may remain flat against the roof structure 1 to support the load thereof. When the extensible parts are to be retracted, the fluid pressure is admitted within the fluid cylinders formed by the various sections to cause the retraction of the various expansible parts. Naturally, it is possible to provide only one ram or to increase the number of rams. The rams can be movably coupled with the roof and floor constructions 1 and 2 in known manner by three-dimensional joints.

Reference numeral 5 denotes a breaking shield which is articulated in known manner, for example, over an axle 6 connected with the end of the roof constructions at the mine filling end. The roof and floor construction, as well as the construction of the breaking shield, and the arrangement and design of the rams 3 and 4 can be selected at random.

As it can be seen from the drawing, two lemniscate guide rods 7 and 8 are articulated at the mine filling end on breaking shield 5. The type and design of the joints are known. In the represented embodiments, the joints are designed as horizontal pivots 9 and 10, which thus permit vertical movements of the lemniscate guide rods 7 and 8.

Figure 2:
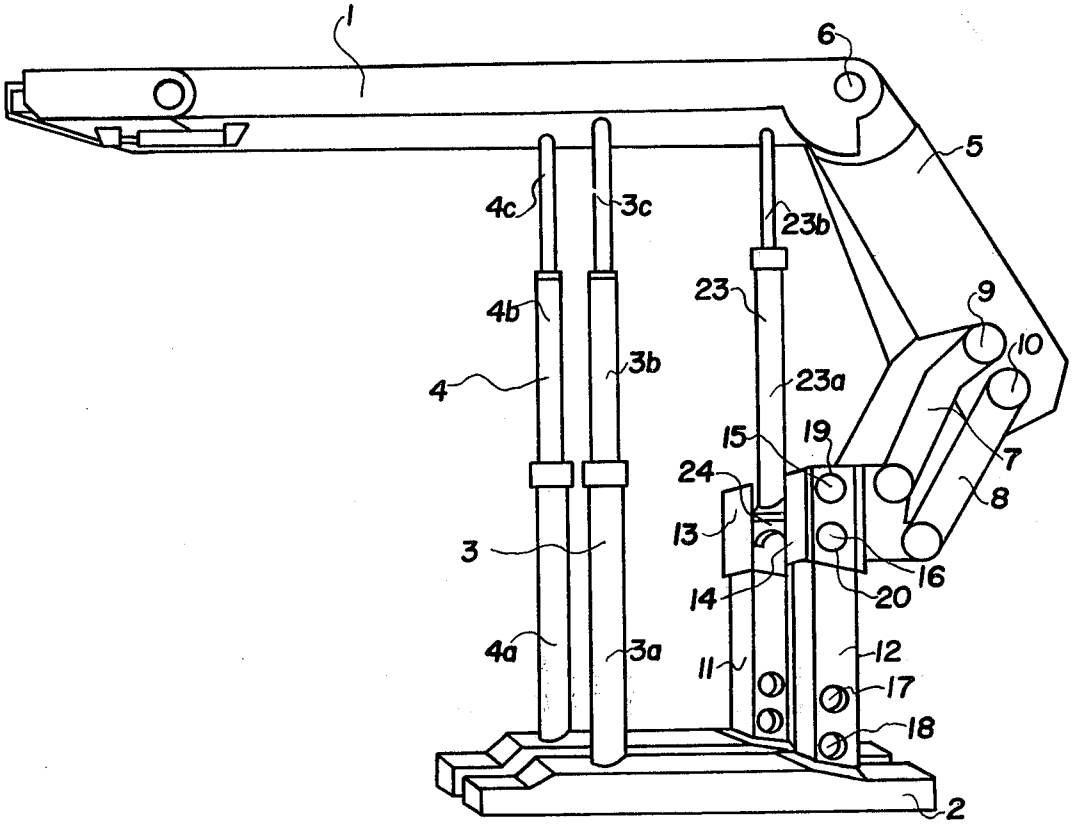
FIG. 2 is a view similar to FIG. 1, showing the shield-type stope support in its maximum extended position.

FIGS. 1 and 2 show particularly clearly that two spaced columns 11 and 12, with their axes parallel to each other, are arranged parallel to rams 3 and 4 at the mine filling end between roof construction 1 and floor construction 2. The columns 11 and 12 are rigidly connected with the floor construction in the represented embodiments and they project freely in the direction of roof 1 (FIG. 2). The columns have, in these embodiments, a cross section extending in a right angle to the longitudinal axis, e.g. a rectangular cross section. They have thus a profile in addition, columns 11 and 12 are box-shaped or designed as hollow or tubular columns. But embodiments are also within the framework of the invention where other cross sectional forms can be used for the columns, for example, pipes or I-girders.

Bearing pieces or tubes 13 and 14, in ring or circular form, embrace columns 11 and 12 and, as shown in the represented embodiment are of similar shape. Consequently, the bearing pieces 13 and 14 likewise a corresponding profile in a cross section extending in a right angle to the longitudinal axis of the respective column 11 or 12. In the represented embodiments they are rectangular both in their inner and in their outer cross section.

Both columns 11 and 12 have several openings over their length, in the represented embodiments a total of four, but for simplicity's sake only the openings or bores of the front column 12 have been provided with reference numbers 15,16,17 and 18, two adjacent each end. The openings or bores of column 11 have the same form and are aligned at the same level with diametrically opposed openings, etc. of the respective other column 12.

Figure 4:
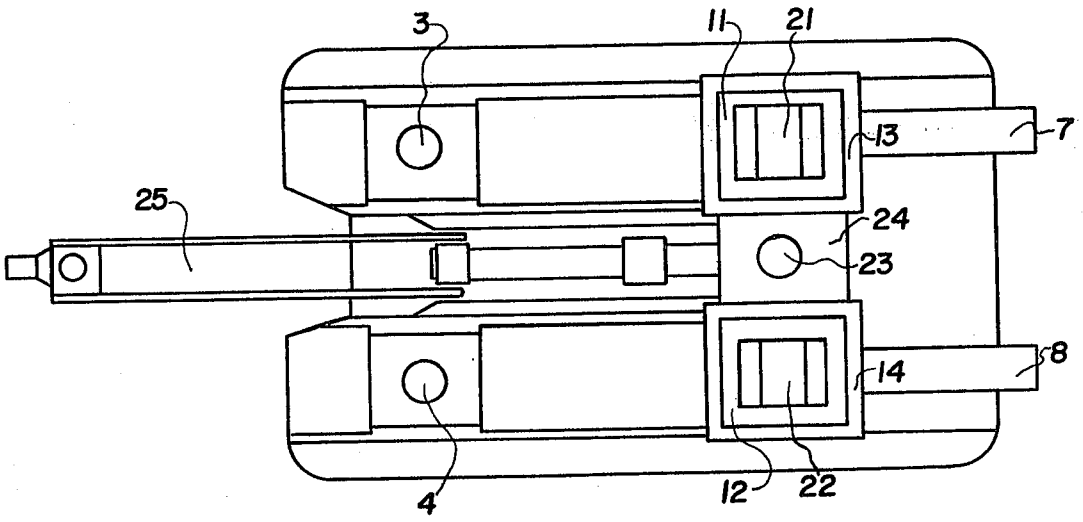
FIG. 4 is a top view of the device shown in FIG. 3.
Figure 5:
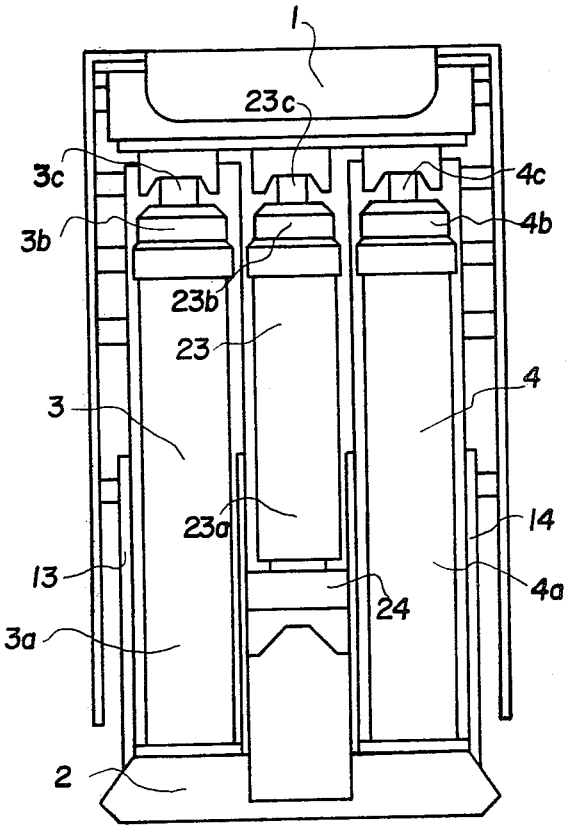
FIG. 5 is a front view of the device shown in FIG. 3.

Bearing pieces 13 and 14 have likewise openings or bores of the same form as the openings etc. 15 to 18. In the represented embodiments, each bearing piece 13 and 14 has two such openings of which, only the two openings 19 and 20 have been provided with reference numbers for simplicity's sake (FIGS. 1 and 2). The respective other openings etc. of the other bearing piece have the same form and are also provided on diametrically opposing sides and at the same levels. Consequently, it is readily possible in the represented embodiments to align bearing pieces 13 and 14 with their openings at a corresponding level with openings, e.g. openings 15 and 16 of columns 11 and 12, so that locking elements, like bolts, can be can be put through these openings, which are designated in FIG. 4 with reference numerals 21 and 22. Bearing pieces 13 and 14 are thus locked at the respective level. Naturally the invention is not limited to the number of openings shown in the drawing. Rather a smaller or a much greater number or a plurality of such bores, etc. can be provided. It is also conceivable to provide the columns at least on one side with teeth, recesses or projections, which can be engaged at the desired level by correspondingly shaped teeth or recesses of the bearing pieces.

A telescopic vertical adjusting element 23 which is designed in these embodiments as a cylinder part 23*a* having telescopic part 23*b* with a piston (not shown) in part 23*a* that can be admitted alternately on both sides with pressure medium pressure, particularly hydraulic fluid to vary the extension of part 23*b*, and which can be designed in the same manner as rams 3 and 4. Vertical adjusting part 23*b* is coupled with the roof construction 1, if necessary movably, for example, by a three-dimensional joint or a universal ball joint (not shown) and this is also true of rams 3 and 4. At the other end (part 23*a*) the vertical adjusting element 23 is coupled with a traverse 24 integrally coupling the two bearings pieces 13 and 14, if necessary, likewise movably, e.g. by a ball and socket joint, a universal ball joint, or any other three dimensional joint (not shown).

Figure 6:
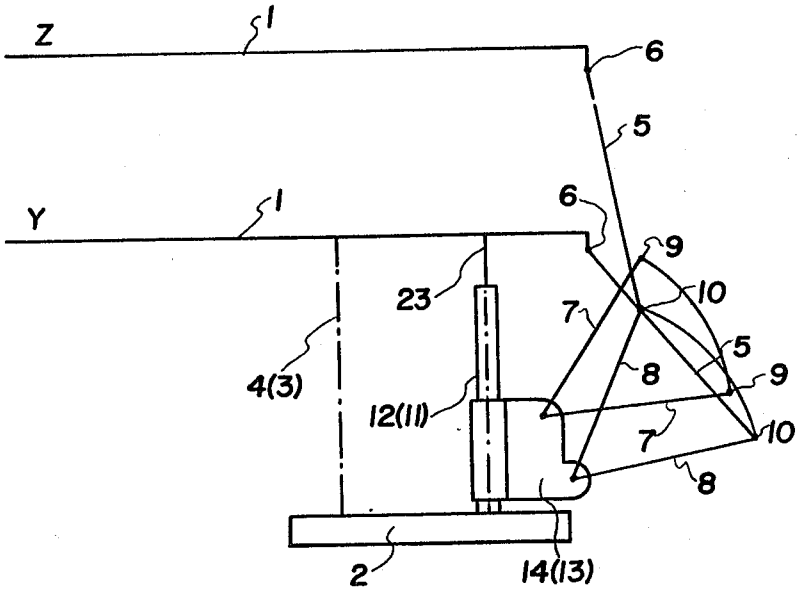
FIGS. 6 and 7 are schematic representations of the mode of operation of a shield-type stope support in respective positions.
Figure 7:
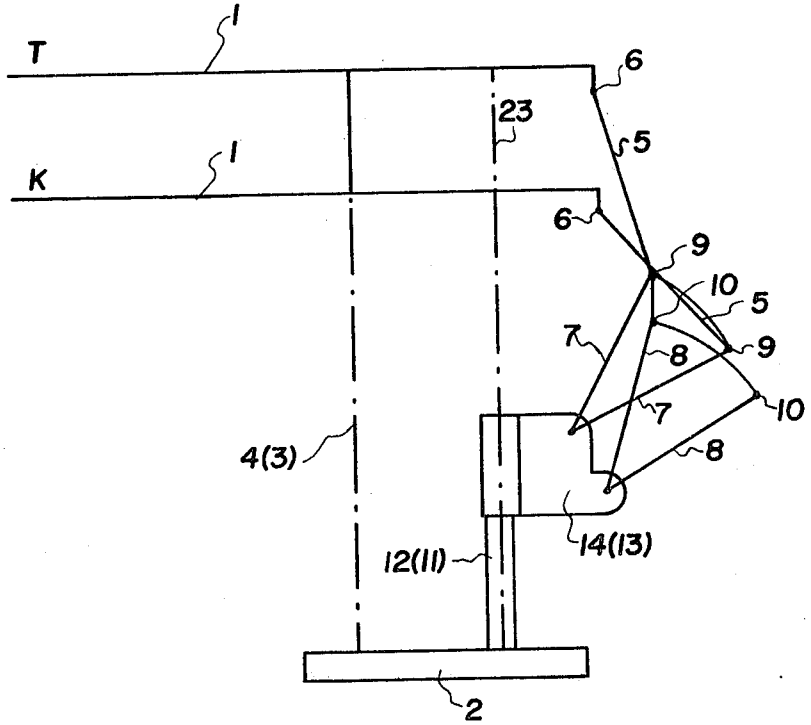

A comparison of FIG. 1 and 2, as well as of FIG. 6 and 7 shown clearly the wide adjustment range of this shield type stope support. For example, one and the same stope support can be used with the same lemniscate guide rod elements, the length of these guide rod elements remains constant, for thicknesses between about 2 and 10 meters, preferably 2½ to 5 meters.

Figure 3:
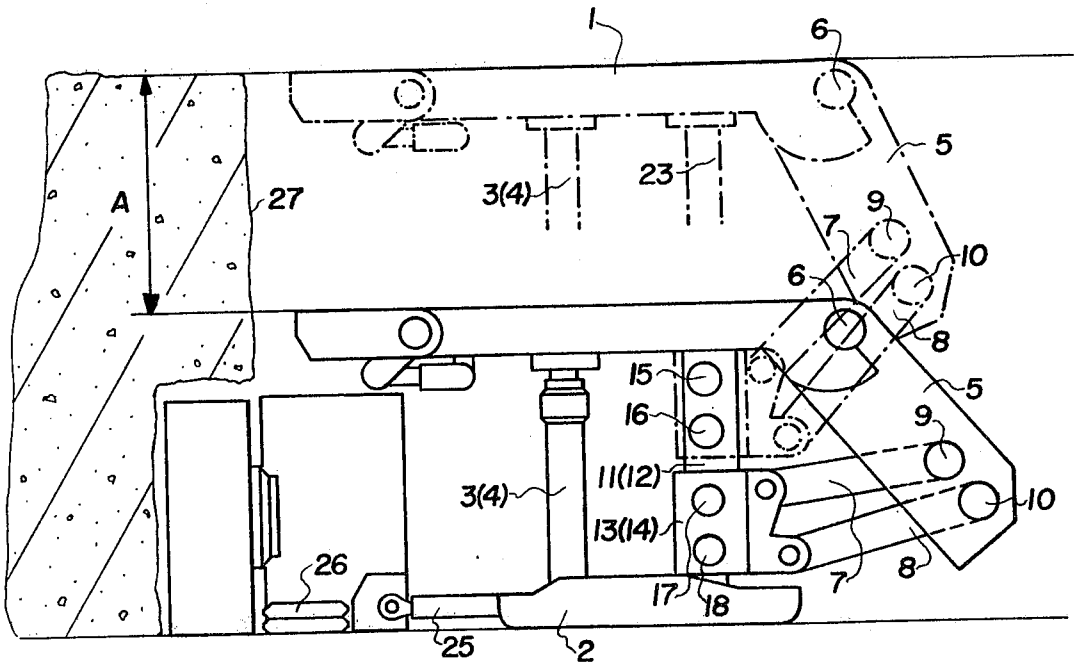
FIG. 3 is a side elevational view showing the shield-type stope support from FIG. 1 and 2 in use in a long-wall, where the stope support is represented in dot-dash lines in an extended position as in FIG. 2.

FIG. 3 also shows that the shield-type stope support is coupled, as usual, by a floor 2 which includes walking legs 25 and, if necessary, indirectly with a conveying means 26, e.g. a face conveyer.

As can be seen from FIG. 6, the roof construction 1 can be raised from the plane, indicated by arrow Y, without adjustment of the articulations of lemniscate guide rods 7 and 8, hence without displacement of bearing pieces 13 and 14, up to plane Z. In one embodiment, plan Y is e.g. at 2,500 millimeter, while plane Z is at 4,000 millimeter level.

Plane or level K in FIG. 7, denotes a plane in which the articulations of lemniscate guide rods 7 and 8 have been adjusted to the maximum height raising lemniscate quide rods 7 and 8, hence without extending the rams correspondingly. This plane K can be in one embodiment, for example, at a level of 4,000 millimeter. From this level K, roof construction 1 can be raised to level T, which is in one embodiment at 5,000 millimeters, for example. Consequently, the total amount of adustment A (FIG. 3) is in one embodiment 2500 millimeter. The length of lemniscate guide rods 7 and 8 can be so selected that adjustment A is a multiple of the length of lemniscate guide rods 7 and 8, for which they would be otherwise suitable without an adjustment possibility of their articulations.

Vertical adjusting element 23 can be braced like rams 3 and 4, naturally after its clearance, and after a vertical adjustment of bearing pieces 13 and 14, if necessary, so that it supports roof construction 1 after bearing pieces 13 and 14 have been locked at any desired level.

The features described in the description and in the claims and represented graphically in the drawings can be essential for the realization of the invention both individually and in any desired combination.

While specific embodiments of the invention have been shown and described in detail to illustrate the application of the principles of the invention, it will be understood that the invention may be embodied otherwise without departing from such principles.

What is claimed is:

1. A shield-type stope support for use in underground mining, comprising a floor construction, at least one fluid pressure operated extensible and retractable ram having a top end, and having a bottom end mounted on said floor construction, a roof member connected to said top end of said ram, at least one column mounted on said floor construction extending upwardly therefrom toward said roof member, a breaking shield having one shield end pivotally connected to said roof structure at a spaced location from the connection of said roof structure to said ram and an opposite shield second end, a lemniscate support mounted on said column for upward and downward movement thereon, and a pair of lemniscate guide rods having first and pivotally connected to said support and opposite second ends pivotally connected to said shield second end.

2. A shield-type stope support according to claim 1 wherein said lemniscate support comprises a tubular member engaged over said column.

3. A shield-type stope support according to claim 1 including at least two spaced apart parallel columns, said lemniscate support comprising a tubular member engaged over each column and a connecting member connected between said tubular members.

4. A shield type stope support according to claim 3 including a fluid pressure operated adjusting element ram mounted on said lemniscate support and a portion thereof extending between said tubular parts and having an upper end connected to said roof element 5. A shield-type stope support according to claim 4 wherein said vertical adjusting element comprises a fluid pressure operated extensible and retractible adjusting ram.

6. A shield-type stope support according to claim 1 including an adjustable element mounted on said lemniscate support and comprising a screw spindle engageable with said roof element.

7. A shield-type stope support according to claim 1 including an adjustment member carried on said lemniscate support and being extensible and retractible and having a top end connected to said roof element.

8. A shield type stope support according to claim 7 wherein said adjustable element comprises a fluid pressure operated piston and cylinder unit.

9. A shield-type stope support according to claim 1 wherein there are two spaced apart substantially parallel columns each of said columns having a plurality of openings defined along the heights thereof, said lemniscate support comprising a member embracing each column having openings which align with the openings of said columns at selected heights and a locking bolt extendible through the openings to lock said support at a selected level.

10. A shield-type stope support according to claim 1 wherein the total amount of vertical adjustability of said lemniscate support corresponds to a multiple of the amount for which the lemniscate guide rods would otherwise be suitable.

11. A shield-type stope support according to claim 1 wherein said pair of lemniscate guide rods comprises first and second guide rod members having pivots at each of their respective ends respectively connected to said lemniscate support and to said shield.

12. A shield-type stope support according to claim 1 wherein said floor construction includes a floor base and an extensible member, movable outwardly and inwardly in respect to said base constituting walking legs.

* * * * *